US006463833B1

(12) United States Patent
Lund

(10) Patent No.: US 6,463,833 B1
(45) Date of Patent: Oct. 15, 2002

(54) TOOL FOR ATTACHING AND REMOVING SWIVEL FITTINGS

(75) Inventor: David Lund, Corinth, VT (US)

(73) Assignee: Victory in Jesus Ministries, Bradford, VT (US)

( * ) Notice: Subject to any disclaimer, the term of this patent is extended or adjusted under 35 U.S.C. 154(b) by 0 days.

(21) Appl. No.: 09/563,180

(22) Filed: May 2, 2000

Related U.S. Application Data

(63) Continuation-in-part of application No. 08/864,981, filed on May 28, 1997.

(51) Int. Cl.[7] ..... B25B 13/02
(52) U.S. Cl. ..... 81/124.2; 81/124.4
(58) Field of Search ..... 81/124.2–124.7, 81/121.1, 177.1, 177.5, 177.85, 180.1, 185, 185.1

(56) References Cited

U.S. PATENT DOCUMENTS

| | | | | | |
|---|---|---|---|---|---|
| 4,393,583 | A | * | 7/1983 | Zwald | 81/124.2 |
| 4,749,251 | A | * | 6/1988 | Moulin | 81/124.2 |
| 4,817,475 | A | * | 4/1989 | Kelly et al. | 81/124.4 |
| 5,035,162 | A | * | 7/1991 | Dougherty | 81/124.4 |
| 5,996,447 | A | * | 12/1999 | Bayouth | 81/124.2 |

* cited by examiner

*Primary Examiner*—D. S. Meislin
(74) *Attorney, Agent, or Firm*—B. Craig Killough

(57) ABSTRACT

A tool for attaching and removing threaded fittings of the type typically used to attach hoses, such as hydraulic hoses, characterized by an extended longitudinal body which is open along a length of the body to accept a hose. The body has an end which will accept and rotate a fastener which is part of the hose fitting, such as a six point fastener, with this end having an open portion to accept the hose. The opposite end of the body will accept a drive tool, such as a ratchet or a pneumatic wrench.

6 Claims, 5 Drawing Sheets

TOOL FOR ATTACHING AND REMOVING SWIVEL FITTINGS

This application is a continuation-in-part of pending application Ser. No. 08/864,981, filed May 28, 1997, pending.

FIELD OF THE INVENTION

This invention relates to a tool for removing and attaching fittings which are used to attach hoses, such as fittings used on hydraulic hoses.

BACKGROUND OF THE INVENTION

Hydraulic hoses are mounted to hydraulic devices or to other hydraulic hoses by means of hydraulic fittings which connect the hoses to the hydraulic device or other hose. Fittings are commonly mounted to the end of the hose and have threaded means for attaching the hose to threads mounted on the device to which the hose is attached, or to the fitting of another hose. The threaded fitting typically has means for rotating a part of the fitting to secure the threads. The fitting may comprise a six-point fastener with accepts an open end wrench of the appropriate size and of the type commonly in use. Fittings typically have a swivel means, which allows the hose to rotate or pivot relative to the fitting and the device to which the device is attached.

Fittings as described, such as hydraulic fittings, may be attached by means of the threads to another threaded fitting which will accept threads. In the prior art, open end wrenches are commonly used to advance and secure the threads, and to remove fittings. The problems with using hand wrenches of this type is two-fold: (1) Rotation of the wrench is relatively slow when compared with other tools, such as ratchets; and (2) the position of the fitting relative to other parts of the machine to which the hose is attached is commonly such that access to the fitting is limited, meaning that the hand wrench either cannot be used, or rotation of the threads by means of the hand wrench is limited to a few degrees.

The use of a ratchet or impact wrench expedites the attachment and removal of various threaded fasteners. Devices known as sockets, which are usually of six point (hexagonal) or twelve point design, are attached to the ratchet or impact wrench, and the socket is rotated to secure the fastener or remove the fastener. Heretofore, no socket has been available for wrenches or impact wrenches which will allow the removal of a threaded fitting which is attached to a hose.

SUMMARY OF THE PRESENT INVENTION

The present invention provides a tool for attaching or removing fittings which are commonly used in conjunction with hoses, such as fittings attached to hydraulic hoses. The device has a removable adaptor with a hex shaped interior which engages the hose fitting, while the opposite end has a drive hole, which is typically rectangular, to accept the square drive of commonly used tools, such as ratchets, torque wrenches or impact wrenches. Interchangeable adaptors having hex shaped interiors of varying sizes the device to be used on multiple sizes of fittings.

The device is of extended length, or elongated, to accept a portion of a hose, such as a hydraulic hose, near the end of the hose to which the fitting is attached, with a longitudinal void in a portion of the elongated body of the device. The hex end is mated to the hexagonal exterior portion of the threaded fitting, with the hose positioned in the longitudinal body at one end and exiting longitudinal body nearer the opposite end. The device is rotated to attach, or remove the fitting, as required.

DESCRIPTION OF THE PREFERRED EMBODIMENT

Figure 2:
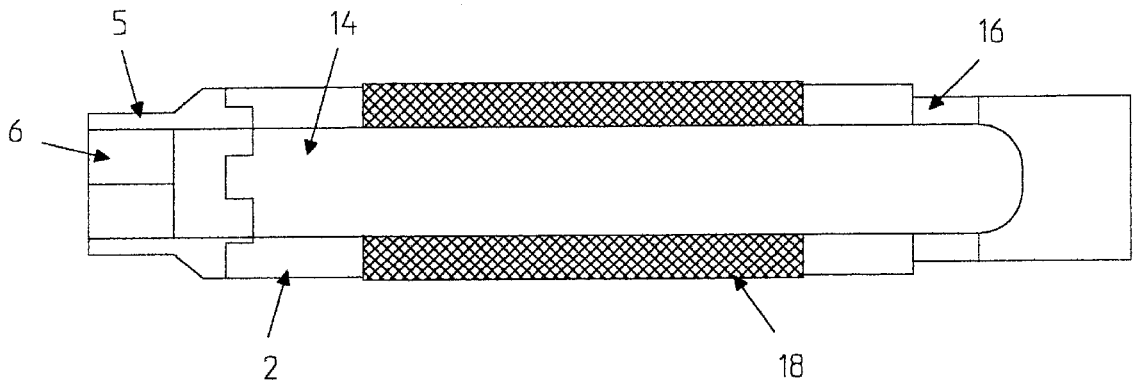
FIG. 2 is a side elevation of device.

Referring now to the drawing figures, FIG. 2 shows the fitting tool having a longitudinal and hollow body 2. The body is open along a substantial portion of the length of the body to receive the hose 4 to which the fitting 8 is attached.

An adaptor 5 is fitted to an end of the body. One end of the body is formed to receive the adaptor. The adaptor has an opening 6 for receiving the fastener which is attached to the hose. The exact size of the opening will depend on the particular size of the fastener which is present on the hydraulic hose to be attached or removed. The opening in the adaptor may be shaped to receive six point or twelve point fasteners, or the opening may otherwise be shaped accordingly to the required application.

Figure 3:
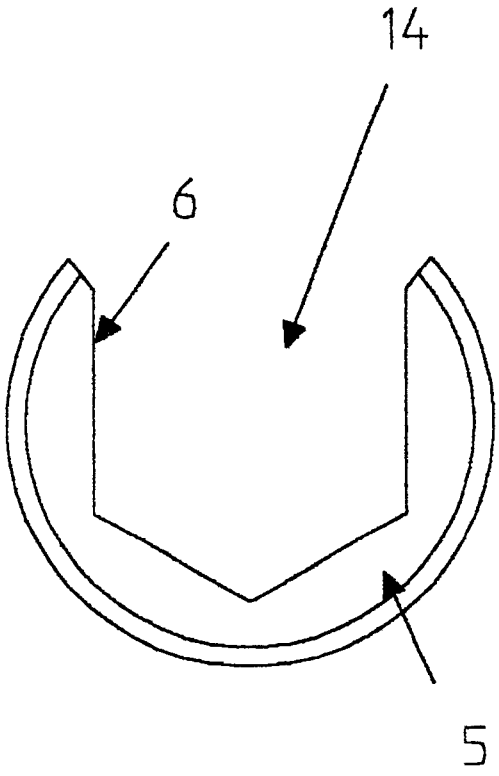
FIG. 3 is an elevation showing the end of the tool having an adaptor fitted thereto.
Figure 4:
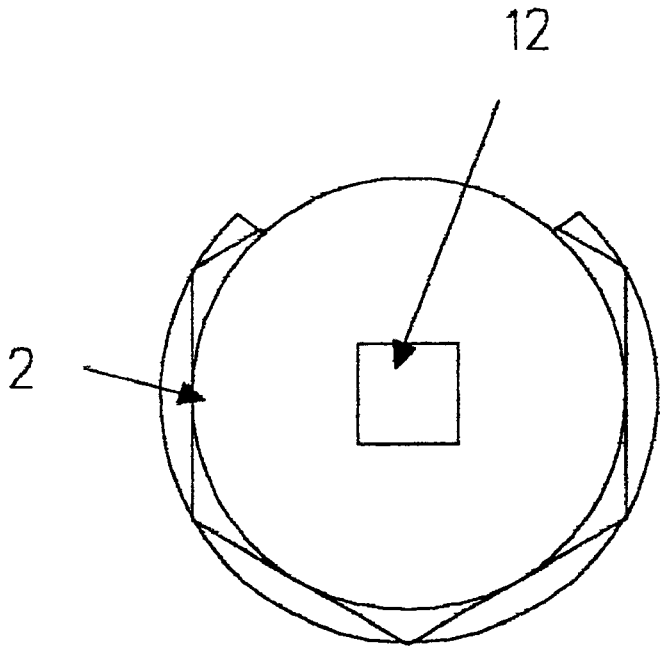
FIG. 4 is an elevation showing the end of the tool which is opposite FIG. 3, showing the drive hole.
Figure 5:
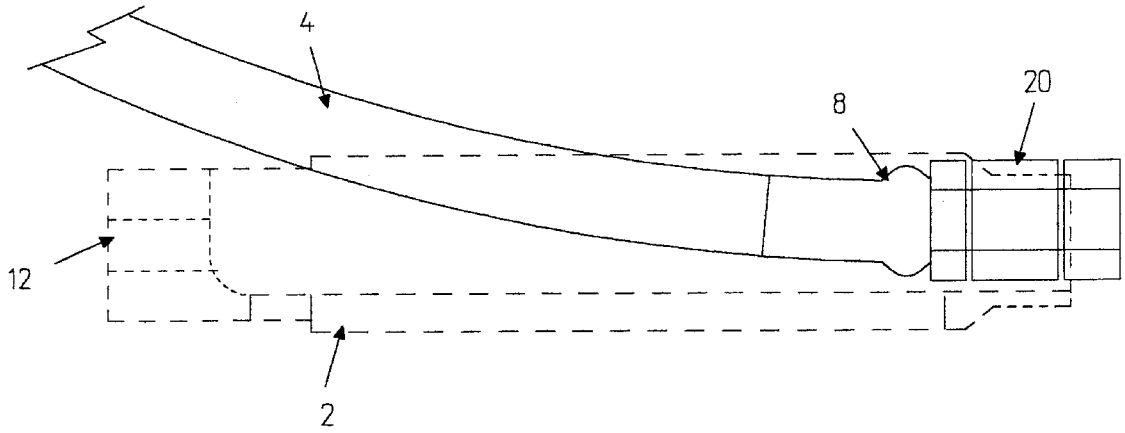
FIG. 5 is a side elevation of the device shown as a phantom, with the hose having a fitting thereon positioned within the tool, for use with the tool.

In the preferred embodiment, the hex shaped opening in the adaptor is actually four sided, with the remaining two sides of the hexagonal shape eliminated. FIG. 3. This shape allows the device to accept the fastener of the fitting which is attached to the hose, and firmly grasp the fastener for rotation of the fastener. On the end of the body opposite the hex shaped end, a drive hole 12 is provided. FIG. 4. This drive hole is sized appropriately for the drive tool, and will most commonly be rectangular according to the drives of ratchets, torque wrenches and impact wrenches in common use. By way of example, the drive hole could be one-quarter inch, three-eighths inch, or one-half inch, or larger, as is appropriate to the fitting, the job and the drive tool to be used. The longitudinal opening 14 of the body is preferred to not extend to the end in which the drive hole is located, so that increased structural integrity is provided in close proximity of the drive hole. Since the application of torque to the device occurs at the drive hole, the structural integrity of the device at this position is important.

In the preferred embodiment, the device also provides an external hexagonal shaped drive 16. As shown, this hex shaped drive has four sides and is open as part of the opening to the longitudinal body. This external hexagonal drive receives an open end wrench and allows an open end wrench to be used to rotate the device. An open end wrench of the appropriate size is attached to the device and is rotated to rotate the device.

A portion of the external surface 18 may be knurled to accommodate handling and manual rotation of the device. A peg board hole 10 may be provided.

As is demonstrated by FIG. 3, the slotted opening of the hollow, longitudinal body, gives the device a u-shape when viewed from the end. In use, the hex opening is mated with the six point fastener 20 of the fitting. The remainder of the fitting, and the end of the hose to which the fitting is attached, extend into the hollow body, and out of the slotted opening. Accordingly, the slotted opening facilitates the engagement of the hex end and accommodates the hose.

When attaching a fitting, the device may be initially rotated by hand for the purpose of engagement of the fitting. Additional torque may be supplied by means of a drive tool fitted to the drive hole. Alternatively, or additionally if increased torque is desired, the hand wrench may be fitted to the external hex. The device is now used to apply torque to the fastener to attach the hose. The hose and fitting are removed in a similar manner by rotating the device in the opposite direction. A drive tool may be fitted to the device by means of the drive hole, and if additional torque is required to loosen the fitting, a hand wrench may be applied to the exterior hexagonal shaped portion of the body.

Adaptors having openings of various sizes may be provided. The openings are matched to the fitting or fastener to be attached or removed, and the adaptor selected accordingly. Adaptors having openings of various sizes may be fitted to a single body, since the adaptors are uniform as structured to be received by and engage the body.

Figure 1:
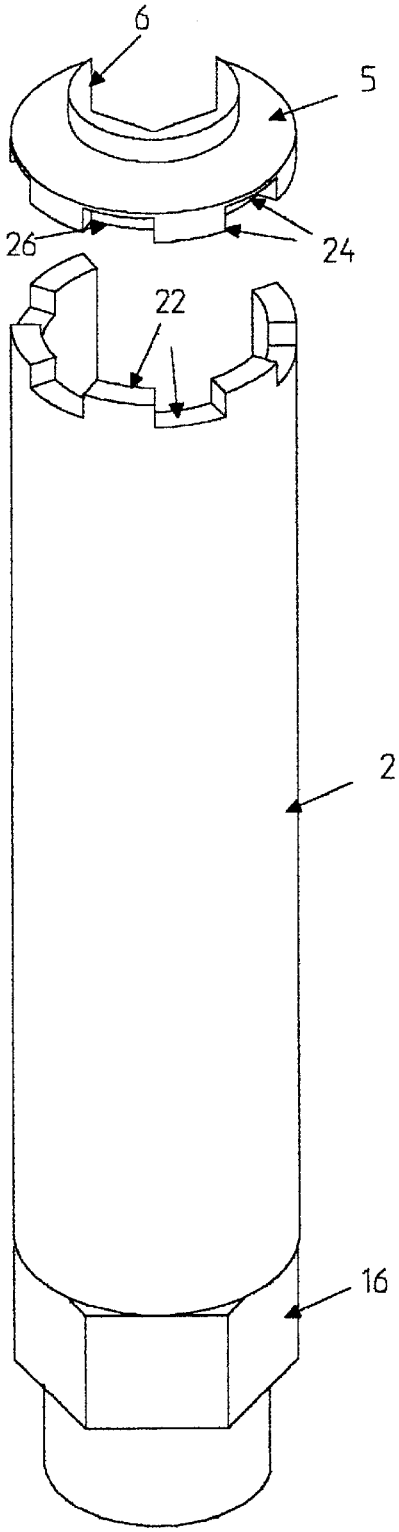
FIG. 1 is an exploded view of the device.

As shown in FIG. 1, the end of the body of the device, which receives and engages the adaptor, has multiple alternating peaks and valleys 22 such as in a dentil or dentated fashion. The adaptor has multiple alternating peaks and valleys 24 in the same manner, but opposite to the peaks and valleys of the body, so that the adaptor engages the end of body as shown in FIG. 1. The peaks and valleys may be described as symmetrical tabs which engage in a male female relationship with a corresponding tab on the other part. The tabs hold the adaptor in place on the body, and receive a torque transfer from the body to the adaptor, which is in turn transferred to the fitting to be attached or removed.

A frictional engagement of the adaptor and the body holds the adaptor in place, although a spring-loaded ball may be provided on the body which engages a detent in the adaptor to further assist in holding the adaptor in place. An internal ridge 26 may be formed on the adaptor to provide additional frictional engagement and adaptor strength.

What is claimed is:

1. A tool for attaching and removing a fitting attached to a hose, comprising a generally hollow, extended and longitudinal body having a longitudinal slot extending along a length of said generally hollow, extended and longitudinal body from a first end of said generally hollow, extended and longitudinal body, to a point along a length of said generally hollow, extended and longitudinal body, wherein said opening does not extend to a second end of said generally hollow, extended and longitudinal body, and wherein, said generally hollow, extended and longitudinal body, has a hexagonally shaped drive near said first end which is truncated by said slot so as to have less than five sides, and wherein said second end has a generally rectangular void therein for accepting a drive tool, and wherein a hexagonally shaped drive is present on an exterior of said generally hollow, extended and longitudinal body and is positioned between said first end and said point along the length of said generally hollow, extended and longitudinal body, and wherein said hexagonally shaped drive has an opening which intersects said longitudinal slot so as to have less than five sides.

2. A tool for attaching and removing a fitting attached to a hose as described in claim 1, wherein the tool further comprises an adaptor which is removably attached to said first end of said generally hollow, extended and longitudinal body, and wherein the hexagonally shaped drive is contained in said adaptor.

3. A tool for attaching and removing a fitting attached to a hose as described in claim 1, wherein said generally hollow, extended and longitudinal body further comprises a knurled exterior portion which circumscribes said generally hollow, extended and longitudinal body along a length thereof, and is positioned between said first end and said second end.

4. A tool for attaching and removing a fitting attached to a hose, as described in claim 1, wherein said body has a plurality of dentils, and said adaptor has a plurality of dentils, and wherein said plurality of said dentils of said body engage said plurality of dentils of said adaptor.

5. A tool for attaching and removing a fitting attached to a hose, as described in claim 2, wherein said body has a plurality of dentils, and said adaptor has a plurality of dentils, and wherein said plurality of said dentils of said body engage said plurality of dentils of said adaptor.

6. A tool for attaching and removing a fitting attached to a hose, as described in claim 3, wherein said body has a plurality of dentils, and said adaptor has a plurality of dentils, and wherein said plurality of said dentils of said body engage said plurality of dentils of said adaptor.

* * * * *